US007900330B2

(12) United States Patent
Vainio et al.

(10) Patent No.: US 7,900,330 B2
(45) Date of Patent: Mar. 8, 2011

(54) METHOD AND DEVICE FOR CHANGING A FABRIC IN A PAPER OR BOARD MACHINE

(75) Inventors: Veli-Matti Vainio, Tampere (FI); Martti Salminen, Lievestuore (FI); Samppa J. Salminen, Muurame (FI); Jyrki Savela, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 812 days.

(21) Appl. No.: 11/910,631

(22) PCT Filed: Apr. 3, 2006

(86) PCT No.: PCT/FI2006/050121
§ 371 (c)(1),
(2), (4) Date: Oct. 16, 2007

(87) PCT Pub. No.: WO2006/106178
PCT Pub. Date: Oct. 12, 2006

(65) Prior Publication Data

US 2008/0209706 A1 Sep. 4, 2008

(30) Foreign Application Priority Data

Apr. 5, 2005 (FI) ..... 20055152

(51) Int. Cl.
*B23P 6/00* (2006.01)
*D21F 1/32* (2006.01)

(52) U.S. Cl. ..... 29/402.08; 162/199

(58) Field of Classification Search ..... 29/402.08, 29/402.01, 402.02, 402.06, 402.09, 402.11, 29/700, 721, 759, 238, 281.4, 281.5; 162/199, 272, 273, 274, 360.2
See application file for complete search history.

(56) References Cited

U.S. PATENT DOCUMENTS 4,452,668 A * 6/1984 Vallius et al. ..... 162/199
6,136,149 A * 10/2000 Vallius ..... 162/199
6,136,169 A 10/2000 Vallius

FOREIGN PATENT DOCUMENTS

FI 103421 B 5/1999
FI 104097 B 11/1999
FI 111172 B 6/2003
WO 2006/106178 A1 10/2006

OTHER PUBLICATIONS

International Preliminary Report on Patentability issued in PCT/FI2006/050121.
International Search Report issued in PCT/FI2006/050121.
Search Report issued in FI 20055152.
English translation of Abstract in FI 103421.

* cited by examiner

*Primary Examiner* — John C Hong
(74) *Attorney, Agent, or Firm* — Stiennon & Stiennon

(57) ABSTRACT

A device has two units placed one on top of the other, each unit comprising a first side frame (101), a second side frame (102) spaced from the first side frame, and a band (130) running between the side frames (101, 102). Each unit (100, 200) has a pressure chamber (300) attached to the side frames (101, 102) and positioned in a sealed manner against the inner surface of the band (130).

14 Claims, 7 Drawing Sheets

METHOD AND DEVICE FOR CHANGING A FABRIC IN A PAPER OR BOARD MACHINE

CROSS REFERENCES TO RELATED APPLICATIONS

This application is a U.S. national stage application of International App. No. PCT/FI2006/050121, filed Apr. 3, 2006, the disclosure of which is incorporated by reference herein, and claims priority on Finnish App. No. 20055152, filed Apr. 5, 2005.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method and a device for changing a fabric in a paper or board machine.

FI patent 103421 discloses a method and a device for changing a fabric in a paper machine. In the method, frame beams of the tending side are moved to a position in which a gap is formed in the vertical frame beams and the fabric is changed through said gap. In the method, the frame parts of the frame beam are raised by an actuator onto support of a device comprising a set of rollers and the fabric is passed through the gap into a throat of the set of rollers. The set of rollers serves as a fabric-pulling device during the change process and after the change the vertical frame beams are lowered onto backing surfaces of the frame parts.

This kind of device formed of a set of rollers comprises a very large number of separate parts, even thousands of parts. The assembly of the device is time-consuming, maintenance is expensive, and the large number of parts additionally reduces the reliability of operation of the device.

The arrangement in accordance with the invention aims to reduce problems associated with the arrangements of the state of the art.

SUMMARY OF THE INVENTION

The device according to the invention includes a very small number of separate parts, a few tens of parts. The device is therefore easy to assemble, inexpensive to maintain and its reliability in operation is good.

A pressure medium between a pressure chamber and a band of the device applies a very even pressure to a fabric passing between bands. The caterpillar track of the set of rollers in accordance with the state of the art is formed of a large number of short pieces, so that a small gap remains between the pieces where pressure on the fabric between the caterpillar tracks is zero. Thus, caterpillar tracks cause an uneven pressure on the fabric passing between the caterpillar tracks.

The definition "paper or board machine" includes in this application all machines and devices that are associated with the manufacture of paper and board and have changeable fabrics, such as paper machines, board machines, tissue machines, pulp machines and belt calenders.

In the following, the invention will be described in detail with reference to the exemplifying embodiments shown in the figures of the appended drawing, to the details of which embodiments the invention is not meant to be limited.

DESCRIPTION OF THE PREFERRED EMBODIMENTS

Figure 1:
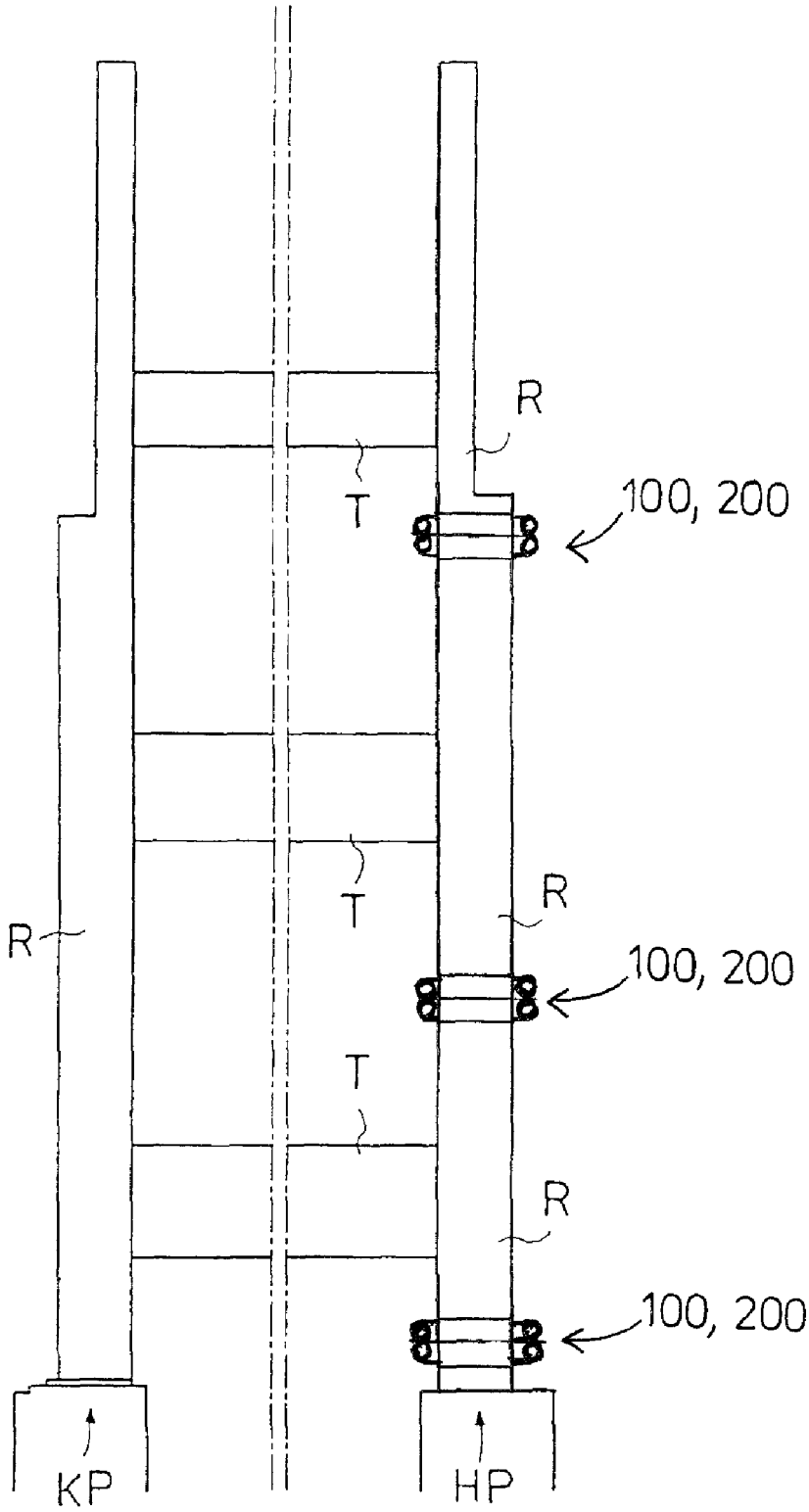
FIG. 1 is a sectional view of frame structures of a press section when viewed in the machine direction.

FIG. 1 is a sectional view of frame structures of a press section when viewed in the machine direction. Support beams T extend between load-bearing beams R from a tending side HP to a driving side KP. Fabric feed devices 100, 200 are mounted in the load-bearing beams R of the tending side HP.

Figure 2:
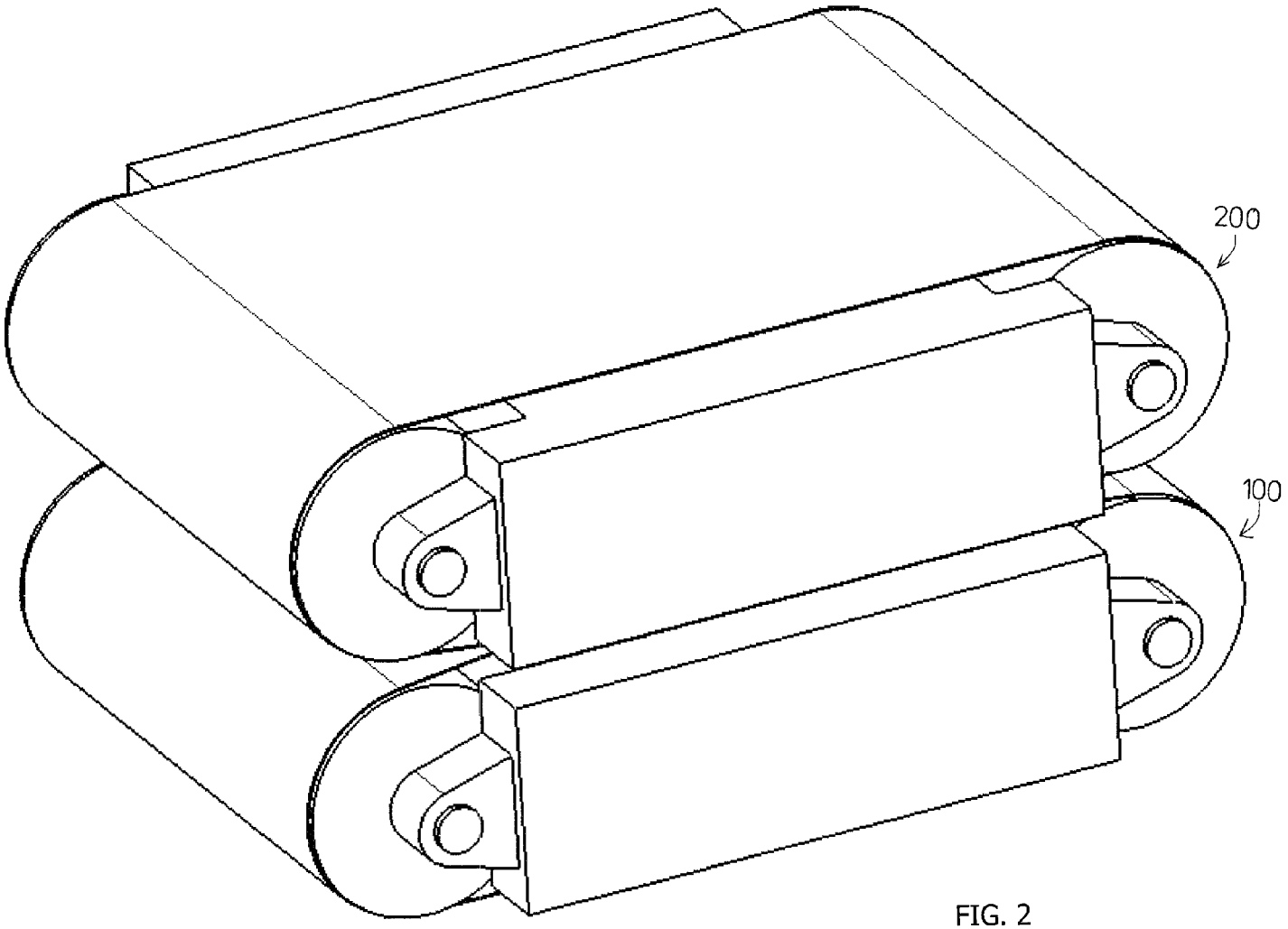
FIG. 2 is an axonometric view of the device in accordance with the invention for changing a fabric.

FIG. 2 is an axonometric view of the fabric feed device 100, 200 in accordance with the invention. The device is formed of two units 100, 200 placed one on top of the other.

Figure 3:
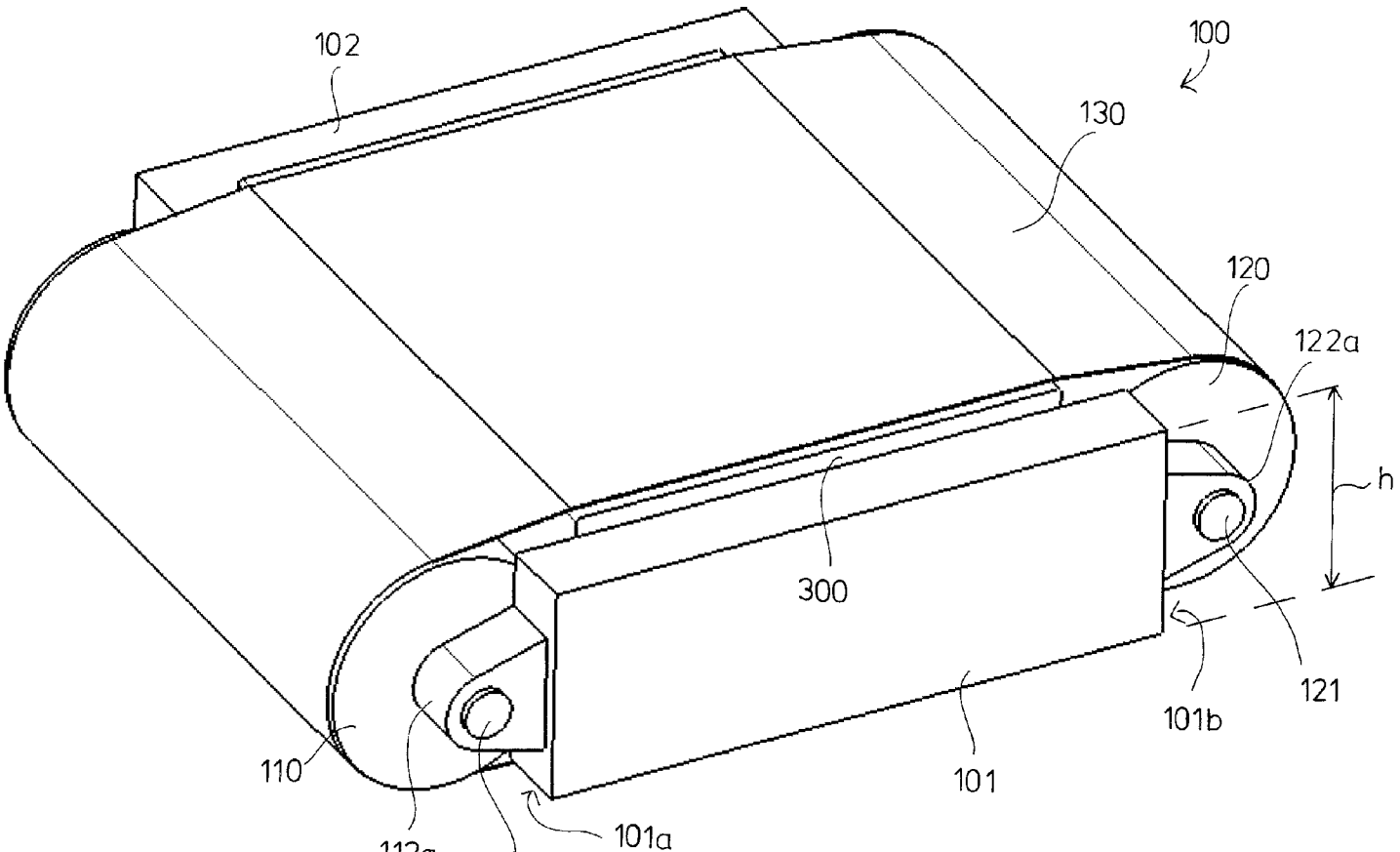
FIG. 3 is an axonometric view of one unit of the device in accordance with the invention.

FIG. 3 shows one unit 100 of the device in accordance with the invention. Each unit 100, 200 comprises a first side frame 101 and a second side frame 102 spaced from the first side frame. The side frames 101, 102 are substantially rectangular, elongated pieces. A first roller 110 is attached to first ends 101*a*, 102*a* of the side frames 101, 102, and a second roller 120 is attached to second ends 101*b*, 102*b* of the side frames 101, 102. An endless band loop 130 rotates around the rollers 110, 120 and runs between the side frames 101, 102. Shafts 111, 121 of the rollers 110, 120 are attached to bearing housings 112*a*, 122*a*, and the bearing housings 112*a*, 122*a* are in turn attached to the ends 101*a*, 101*b* of the side frames 101, 102. The height h of the side frames 101, 102 is slightly greater than the diameter of the rollers 110, 120 plus the thickness of the band 130 multiplied by two. The first 110 and/or the second 120 roller can be provided with a drive, for example, by means of a drive motor arranged inside the roller 110, 120. A pressure chamber 300 is disposed between the side frames 101, 102, the band 130 running over said pressure chamber. The side frames of the upper unit 200 of the device are attached to a load-bearing beam R of the tending side HP of the machine on the upper side with respect to the device, and the side frames 101, 102 of the lower unit 100 of the device are attached to a load-bearing beam R of the tending side HP of the machine on the lower side with respect to the device. The side frames 101, 102 of the units 100, 200 of the device can be attached to each other when the machine is operated, for example, by means of eye nuts suitable for the purpose and easy to detach in connection with a fabric change (not shown in the figures).

Figure 4:
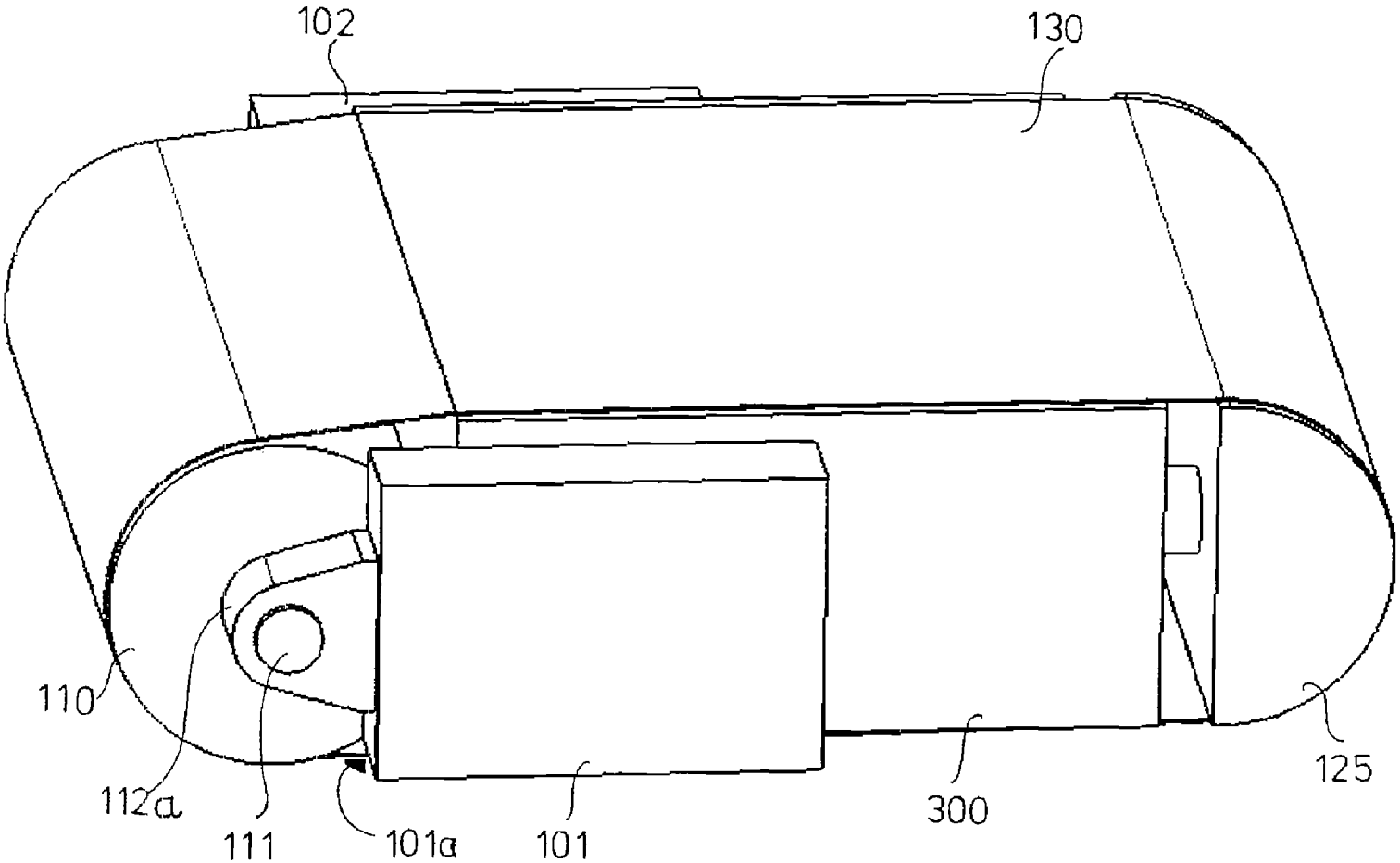
FIG. 4 is an axonometric view of a variant of the device illustrated in FIG. 3.

FIG. 4 shows a variant of the unit shown in FIG. 3. In this embodiment, a roller 110 is used only at one end of the unit. At the opposite end there is, instead of a roller, a curved surface 125, over which a band 130 runs. In this case, a drive is in the roller 110 situated at the one end of the unit.

Figure 5:
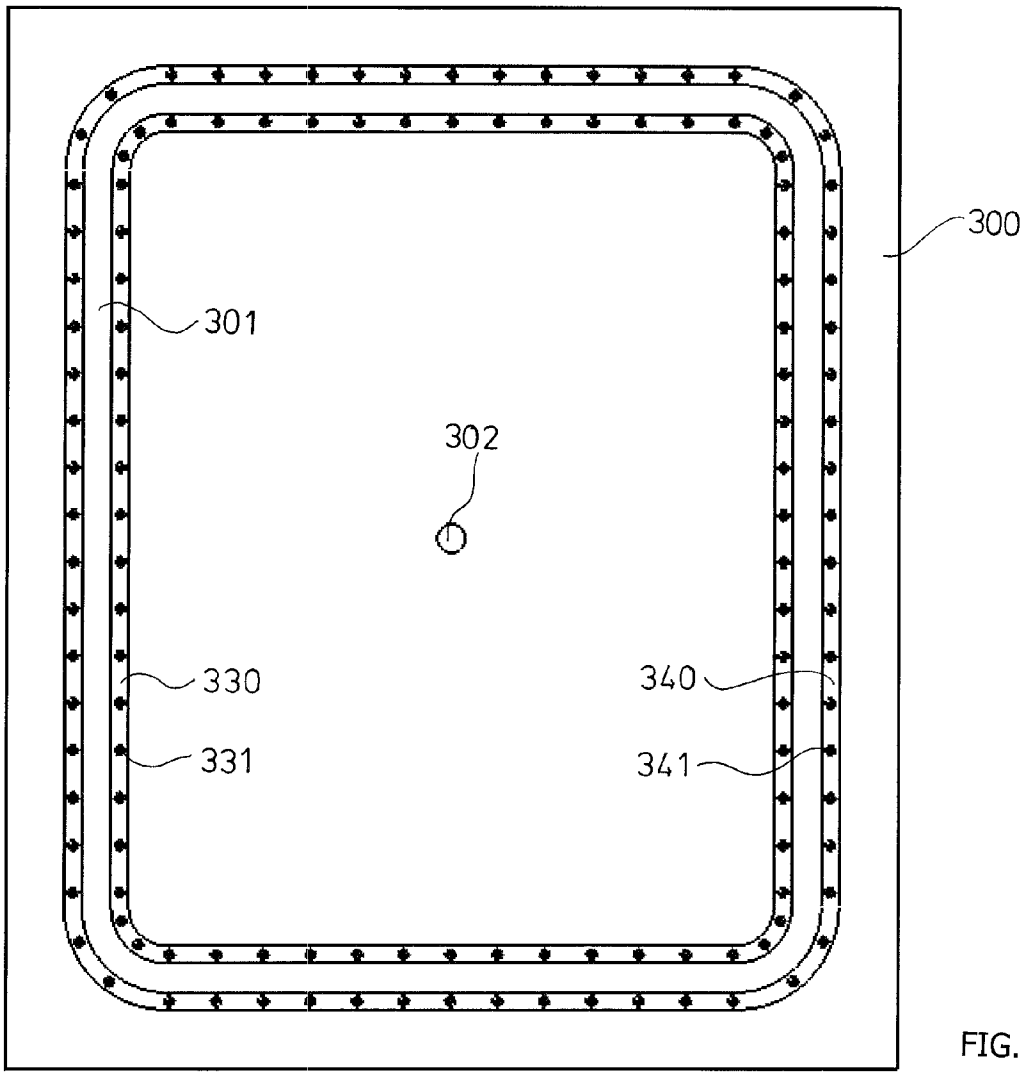
FIG. 5 shows a pressure chamber of the device in accordance with the invention in a top view.

FIG. 5 shows a pressure chamber 300 in a top view. The pressure chamber 300 is formed of a rectangular piece attached at its edges to the side frames 101, 102 of the unit. A rectangular groove 301 having rounded corners is formed in that surface of the pressure chamber 300 which is positioned against the inner surface of the band 130. In the area defined by the groove 301 within itself there is an inlet opening 302 for a pressure medium. At the inner edge of the groove 301 there is a first seal holder 330 and at the outer edge of the groove 301 there is a second seal holder 340. The seal holders 330, 340 are fixed by fixing means, preferably by screws 331, 341 to the pressure chamber 300.

Figure 6:
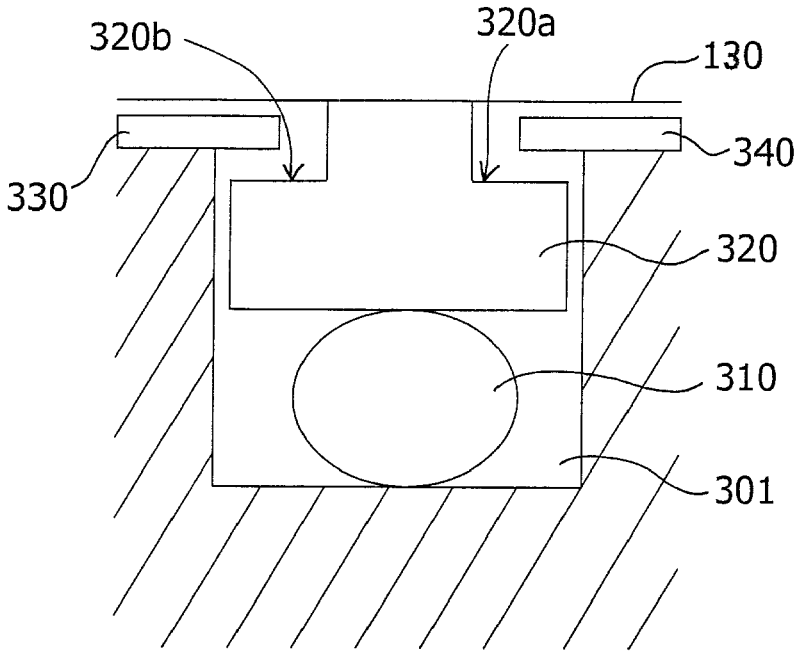
FIG. 6 is a sectional view of the pressure chamber and seals placed in it in a situation in which the pressure chamber is unpressurized.
Figure 7:
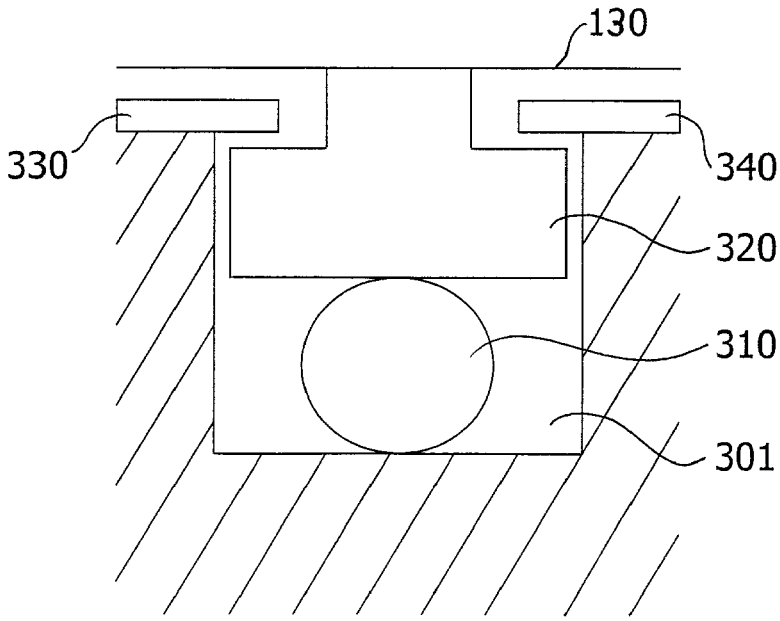
FIG. 7 is a sectional view of the pressure chamber and seals placed in it in a situation in which the pressure chamber is pressurized.

FIGS. 6 and 7 show a cross-section of the groove 301 of the pressure chamber and of the seals placed in the groove. FIG. 6 depicts the pressure chamber in a rest position, i.e. in an unpressurized position, and FIG. 7 depicts the pressure chamber in a pressurized position. A first seal 310, whose cross-section is substantially round, i.e. it can also be a rounded polyhedron, is mounted on the bottom of the groove 301 having a rectangular cross-section. A second seal 320, whose cross-section is substantially in the shape of an inverted letter T or a shaped joint with shoulders limiting the displacement of the seal by means of the shoulders in a corresponding manner, is mounted on the first seal 310. This second seal 320 forms a slide seal for the steel band 130. In the rest position the first seal 310 is compressed, whereby it produces a lifting force for the second seal 320. This lifting force presses the second seal 320 into contact with the inner surface of the band 130. When a pressure medium is fed from the pressure medium inlet opening 302 shown in FIG. 5 into the pressure chamber, the pressure medium spreads into a space between the surface of the pressure chamber and the band 130 and further into the groove 301. In the groove 301 the pressure medium causes a lifting force for the second seal 320, whereby the second seal 320 rises upwards in proportion as the pressure medium raises the band 130 and the load situated on the band. When shoulders 320*a*, 320*b* of the second seal 320 come into contact with the seal holders 330, 340, the rising movement of the second seal 320 stops. Then, an increase in the pressure of the pressure medium no longer raises the band 130 and the load on it, but, instead, the pressure medium discharges from between the second seal 320 and the band 130 out of the pressure chamber. A slide surface is thereby formed of the pressure medium between the second seal 320 and the band 130, the band 130 sliding almost without any friction over the second seal 320.

Figure 8:
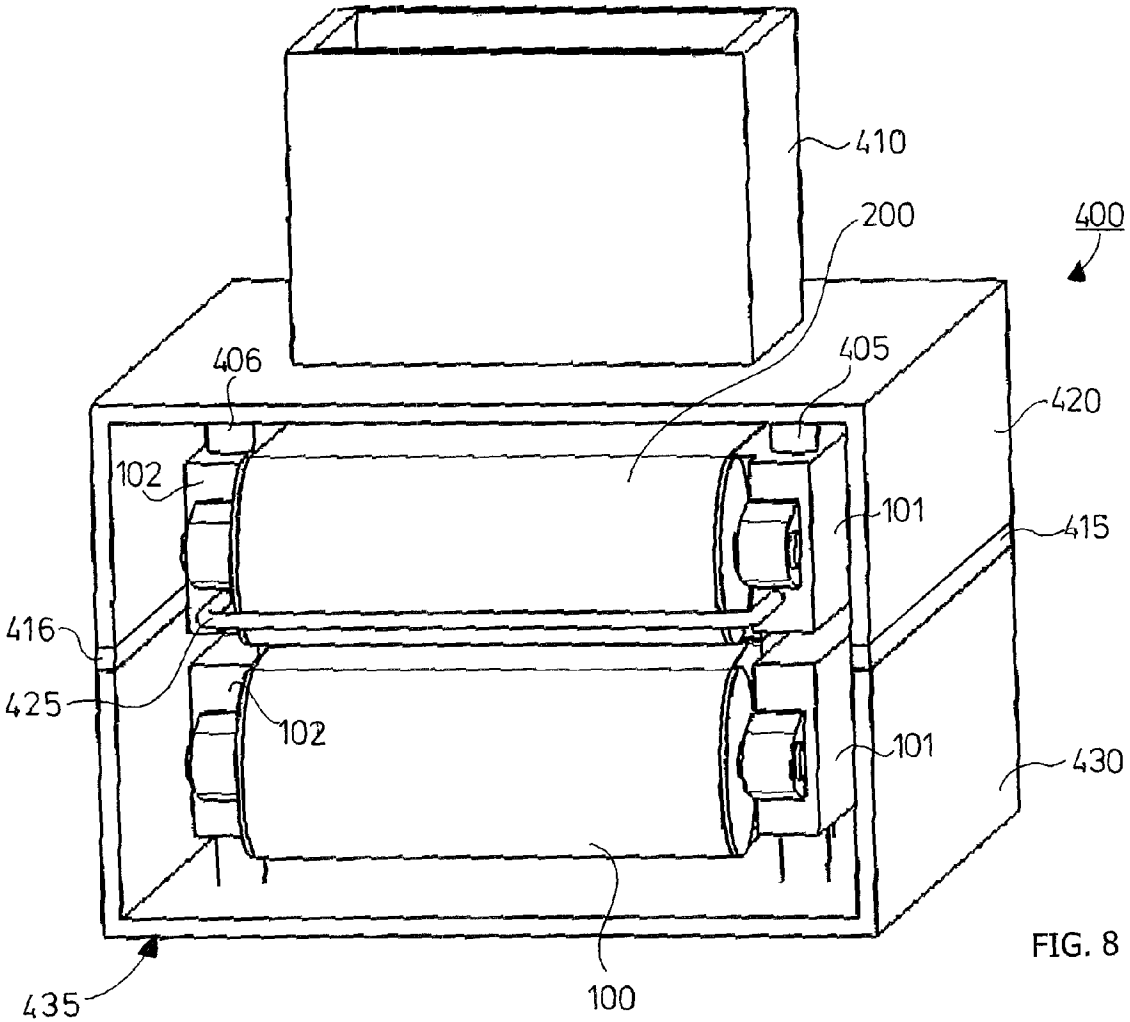
FIG. 8 is an axonometric view of an application of the device of the invention provided with a protective frame.

In accordance with the application shown in FIG. 8, the device of the invention can be provided with an outer frame 400, which forms a protection for the device according to the invention. The outer frame 400 comprises an upper frame 410 and an extension part 420 of the upper frame as well as an extension part 430 of a lower frame. Spacer blocks 415 and 416 can be arranged in the extension part of the upper frame and the lower frame. The parts of the outer frame 400 protect the device 100, 200 in accordance with the invention and the extension part 420 of the upper frame also protects the device when the device is not in use. The extension part 430 of the lower frame also protects and surrounds the device. The spacer blocks 415 and 416 possibly arranged between the extension part 420 of the upper frame and the extension part 430 of the lower frame are removed when the device and/or separate jacks 405, 406 lift the parts 420, 430 apart from each other. The jack parts 405, 406 can be placed in connection with the device, when needed, for example, in a situation when the lifting distance of the device 100, 200 itself is not sufficient. In addition, in connection with the device it is possible to arrange a cleaning device 425 for the fabric to be pulled in, for example, at least one of the surfaces of the fabric is cleaned using a pneumatic or hydraulic means such that fabric-damaging particles cannot enter the feed-in nip. The use of this kind of cleaning device 425 is very advantageous, for example, when the device is used for feeding in a wire, in which connection even a small dry particle might make a hole in a thin wire. In connection with the device it is also possible to arrange a cleaning device, for example, a doctor or equivalent, for its bands. A door can also be arranged at the front side of the outer frame 400, which is indicated by the arrow 435, thereby enabling the structure to be closed completely from contamination splashing from the surroundings. When equipped with the outer frame 400 illustrated in the figure, comprising the upper frame extension part 420 and the lower frame extension part 430, the device can be replaced when fabrics are not being pushed into the machine because the frames and their extension parts carry the load. In that connection, it is advantageous to arrange, for example, rails in connection with the extension part of the lower or upper frame of the outer frame to replace the device. The rails can be, for example, of telescopic construction.

The operation of the device is described next. In the rest position, the units 100, 200 are in the load-bearing beam R of the tending side HP one on top of the other such that the load carried by the load-bearing beam R is transmitted to support points of the vertical frames R only through the side frames 101, 102 of the units or through the frames surrounding the device. The bands 130 of the units are not subjected to any load. When the pressure chamber inside the lower unit 100 and the pressure chamber inside the upper unit 200 are pressurized, the load is transferred from the side frames of the units to the pressure chambers and to the bands. The side frames are separated from each other to the extent that there is room for a fabric to pass between them, and the pressure medium between the pressure chamber and the band carries the load. Between the units, the band is subjected only to the friction caused by the pressure medium, said pressure being very small. The fabric can now be pushed into the throat between the bands, wherefrom it is transferred between the bands through the device. A drive motor is coupled to at least one roller of one band for pulling the band and, with it, the fabric through the device. When the fabric is pushed into the throat between the bands, a suitable wedge piece can be used ahead of the fabric in order that the fabric may be brought more easily between the bands without the inlet edge of the fabric being damaged. Such a wedge piece can also be used at the trailing edge of the fabric so that the trailing edge of the fabric should not be damaged when the fabric is transferred through the device.

In the embodiment shown in FIGS. 2-3 there is a roller 110, 120 at both ends of each unit 100, 200 and in the embodiment shown in FIG. 4 one roller 120 is replaced with a curved slide surface 125. It may also be contemplated that the rollers at both ends of the unit are replaced with curved slide surfaces. In that case, the fabric is placed between the bands 130 and pulled with the bands 130 to the inner side of the load-bearing beams R on the tending side HP of the machine. The pressure chambers 300 are then pressurized such that the side frames 101, 102 of the device are separated from each other, and the pressure medium of the pressure chambers 300 and the bands 130 carry the load. The pulling of the fabric placed between the bands through the device can then be accomplished using conventional means, for example, a block and tackle or a winch.

The band 130 is advantageously made of metal, such as steel, but a polymer fiber band can also be used. A liquid, such as water or oil, can be advantageously used as the pressure medium of the pressure chamber 300, but gas is also possible.

The seal holders 330, 340 are also advantageously formed of metal.

Because of the rectangular groove 301, the pressure area of the pressure chamber 300 can be made to match the area of the rectangular band 130 well, but any other polyhedron-, circle- or oval-shaped groove 301 is also possible. There can also be several chambers although it is more advantageous to accomplish one chamber.

The material of the first seal 310 is advantageously rubber and the material of the second seal 320 is advantageously graphite.

Above, the invention has been described in connection with a press section, which is one advantageous site of application of the invention. However, the invention can be applied in all web-forming equipment having changeable fabrics.

The various details of the invention may vary within the inventive idea defined by the claims set forth below and differ from those given above by way of example only.

The invention claimed is:

1. A method for changing a fabric in a paper or board machine having a tending side supported by a plurality of load-bearing support beams, the method comprising the steps of:

forming at least one gap through each of said load-bearing support beams between an upper portion and a lower portion of each of said load-bearing support beams, by pressurizing a first pressure chamber mounted to the upper portion with pressure medium, which first pressure chamber is sealed against an inner surface of a first band, and supporting said first band with pressure medium, and forming the gap by pressurizing a second pressure chamber mounted to the lower portion with pressure medium, which second pressure chamber is sealed against an inner surface of a second band, and supporting said second band with pressure medium, so that the first band and the second band are free to move together supported by pressure medium between the first pressure chamber and the second pressure chamber through said load-bearing support beams; and passing the fabric through the plurality of load-bearing support beams between the first band and the second band of each of the gaps formed in the plurality of support beams.

2. The method of claim 1, wherein the step of passing the fabric through the plurality of load-bearing support beams between the first band and the second band of each of the gaps includes the step of operating a drive motor connected to a roller positioned within a continuous loop formed by one of said first band and said second band and by pushing the fabric into a throat formed between the first band and the second band, wherefrom it is transferred between said bands through said load-support beams.

3. The method of claim 1, wherein after forming at least one gap through each of the load-bearing support beams, further comprising the step of closing the gaps and forming a load support path between said upper portion and said lower portion of each of said load-bearing support beams.

4. A device for changing a fabric in a paper or board machine, comprising:

a plurality of load-bearing support beams on a tending side of the paper or board machine, each load-bearing support beam having an upper portion and a lower portion;

a first unit mounted to each upper portion, the first unit having a first side frame, a second side frame spaced from the first side frame, a first band running between the side frames and a first pressure chamber attached to the first side frame and the second side frame, the first pressure chamber being positioned in a sealed manner against an inner surface of the first band;

a second unit mounted to each lower portion, the second unit having a first side frame, a second side frame spaced from the first side frame, a second band running between the side frames and a second pressure chamber attached to the first side frame and the second side frame, the second pressure chamber being positioned in a sealed manner against an inner surface of the second band;

wherein the first unit is mounted above the second unit so that the first band is positioned overlying the second band, and the first unit first side is engageable in supporting relation to the second unit first side, and the first unit second side is engageable in supporting relation to the second unit second side; and wherein the first pressure chamber and the first band are arranged opposite the second band and the second pressure chamber so that when pressure medium is supplied to the first pressure chamber and to the second pressure chamber, the first unit first side is spaced from the second unit first side, and the first unit second side is spaced from the second unit second side to allow the fabric to pass between the first band and the second band and thus through each load-bearing support beam.

5. The device of claim 4, wherein the first device further comprises a first roller attached to first ends of the first and second side frames and a second roller attached to second ends of the first and second side frames, and the first band being formed of a closed band loop rotating around the first and second rollers; and wherein the second device further comprises a first roller attached to first ends of the second device first and second side frames and a second roller attached to the ends of the first and second side frames of the second device, and the second band being formed of a closed band loop rotating around the first and second rollers of the second device.

6. The device of claim 4 wherein the first and second pressure chambers each comprises:

a rectangular plate having a surface and portions of the rectangular plate defining a groove forming a closed loop enclosing a portion of the surface to define the pressure chamber; and portions of the rectangular plate defining an inlet opening, which opens into the pressure chamber.

7. The device of claim 6, wherein the groove of each of the first and second pressure chambers has a bottom and further comprises:

a first seal which is round in cross-section and which engages the groove bottom;

a second seal on top of the first seal, the second seal having an inverted T-shape, the second seals sealing the first and second pressure chambers against the inner surface of the first band loop, and the second band loop respectively.

8. The device of claim 7, wherein the groove has a first edge and mounted thereto a first seal holder which partly covers the groove, and wherein the groove has at a second edge and mounted thereto a second seal holder, which partly covers the groove, such that there is room for a vertical arm of the inverted T-shaped second seal to move in a gap defined between the first seal holder and the second seal holder in the depth direction of the groove, so that shoulders formed by horizontal arms of the inverted T-shaped second seal limit the movement of the second seal in a direction outwards from the groove when the shoulders come into contact with the seal holders.

9. The device of claim 4, wherein the first unit and the second unit are arranged inside an outer frame, which outer frame comprises an extension part of the load-bearing support beam upper portion and an extension part of the load-bearing support beam lower portion.

10. The device of claim 9, wherein the outer frame further comprises a door arranged on a front side of the first unit and the second unit.

11. The device of claim 9, further comprising spacer blocks arranged between the extension part of the load-bearing support beam upper portion and the extension part of the load-bearing support beam lower portion.

12. The device of claim 9 further comprising a jack positioned between the first unit first side and the load-bearing support beam upper portion and a jack positioned between the first unit second side and the load-bearing support beam upper portion.

13. The device of claim 9 wherein the first unit and the second unit are mounted to a rail structure on the outer frame for movement.

14. A device for passing a fabric through tending side load-bearing support beams in a paper or board machine, the device comprising:

a first unit mounted to an upper portion of a load-bearing support beam, the first unit having a first side frame, a second side frame spaced from the first side frame, and a first pressure chamber attached between the first side frame and the second frame;

a first closed band loop surrounding the first pressure chamber and running between the first side frame and the second side frame and positioned with an inner surface sealed against the first pressure chamber;

a second unit mounted to a lower portion of the load-bearing support beam, the second unit having a first side frame, a second side frame spaced from the first side frame, and a second pressure chamber attached between the first side frame and the second frame;

a second closed band loop surrounding the second pressure chamber and running between the first side frame and the second side frame and positioned with an inner surface sealed against the second pressure chamber;

wherein the first unit is mounted above the second unit so that the first band is positioned overlying the second band, and in a first condition the first unit first side is engageable in supporting relation to the second unit first side, and the first unit second side is engageable in supporting relation to the second unit second side; and wherein the first pressure chamber, and the first band are arranged opposite the second band and the second pressure chamber so that in a second condition, when pressure medium is supplied to the first pressure chamber and to the second pressure chamber, the first unit first side is spaced from the second unit first side, and the first unit second side is spaced from the second unit second side to allow the fabric to pass between the first band and the second band and thus through the load-bearing support beam.

* * * * *